United States Patent [19]

Inoue

[11] Patent Number: 4,509,729

[45] Date of Patent: Apr. 9, 1985

[54] HOT ISOSTATIC PRESSING APPARATUS

[75] Inventor: Yoichi Inoue, Hyogo, Japan

[73] Assignee: Kabushiki Kaisha Kobe Seiko Sho, Kobe, Japan

[21] Appl. No.: 545,516

[22] Filed: Oct. 26, 1983

[30] Foreign Application Priority Data

Oct. 29, 1982 [JP] Japan ..... 57-165347[U]

[51] Int. Cl.[3] ..... F27B 5/04

[52] U.S. Cl. ..... 266/252; 425/78; 425/405 H

[58] Field of Search ..... 425/78, 405 H; 266/252, 266/255; 432/247, 249, 206

[56] References Cited

U.S. PATENT DOCUMENTS 3,419,935 1/1969 Pfeiler et al. ..... 425/405 H
4,238,667 12/1980 Conaway ..... 425/405 H

FOREIGN PATENT DOCUMENTS 821064 4/1981 U.S.S.R. ..... 432/247
825283 4/1981 U.S.S.R. ..... 425/78

*Primary Examiner*—L. Dewayne Rutledge
*Assistant Examiner*—Christopher W. Brody
*Attorney, Agent, or Firm*—Oblon, Fisher, Spivak, McClelland & Maier

[57] ABSTRACT

A hot isostatic pressing apparatus equipped with a pressure vessel, a heat-insulating layer provided within the pressure vessel and a heating unit disposed inside the heat-insulating layer, in which the heating unit is formed of a cylindrical, self-standing and single-stage heater mounted on an electrical insulator, which is in turn provided in a low-temperature zone of the pressure vessel, and a convection-promoting cylinder provided inside the heater with its lower part supported on the electrical insulator, wherein the upper extremity of the convection-promoting cylinder is located above the upper extremity of the heater, and the convection-promoting cylinder defines a gas flow passage in the lower part thereof. Owing to the provision of the convection-promoting cylinder, the effective height of the uniform temperature zone, namely, the treatment spacing in the pressure vessel is increased by 1.5–3.0 times as compared with a conventional hot isostatic pressing apparatus equipped with no such convection-promoting cylinder and the single-stage heater allows for a reduction in the overall size of the pressing apparatus.

5 Claims, 4 Drawing Figures

HOT ISOSTATIC PRESSING APPARATUS

BACKGROUND OF THE INVENTION

1. Field of the Invention

This invention relates to a hot isostatic pressing apparatus (hereinafter abbreviated as "HIP apparatus" for brevity), and more particularly to an HIP apparatus equipped with a novel heating unit which permits a more effective use of the interior space of a pressure vessel and enlarges the height of the uniform temperature zone by 1.5–3 times that of a conventional heating unit equipped with a heater of the same height.

2. Description of the Prior Art

An HIP apparatus is one of many apparatuses which have recently found wide-spread commercial utility in a broad field led by the forming and sintering of powder and including the diffusion bonding and elimination of casting defects and have thus drawn the attention of engineers. It is generally operated under high-temperature and high-pressure conditions of at least 1,000° C. and at least 1,000 kg/cm$^2$. As a facet of recent trend, it has been attempted to operate such an HIP apparatus, especially, at high pressures reaching 2,000 kg/cm$^2$ or so. In such a high pressure atmosphere, the heat capacity of a gaseous substance is increased to a considerable extent and the temperature distribution of the gaseous substance in a high-temperature and high-pressure furnace becomes significantly uneven. The length of the uniform temperature zone in the high-temperature and high-pressure furnace is rendered very short, thereby limiting the actually-effective length to only a part of the furnace. This is extremely uneconomical from the viewpoint of making efficient use of the internal spacing of the expensive high pressure vessel.

Taking a hint from the fact that a multistage and self-standing heater can be readily obtained by fixedly connecting a plurality of heating elements to one another with ring-shaped porcelain insulators, each multistage and self-standing heaters have generally been used in order to enlarge the constant temperature zones.

However, such conventional multistage and self-standing heaters are accompanied by a drawback in that they have become larger and the HIP apparatuses have hence been scaled up. Moreover, such are accompanied by another drawback in that the thermal stresses, which are developed due to difference in thermal expansion between the porcelain insulators and heaters, have become greater and parts having weaker strength are broken. They are also accompanied by a further drawback in that the selection of porcelain insulators having good electrical insulation and impact resistance at high temperatures leads to an increase in production cost and difficulties in production technique.

Coupled with actual utilization of an HIP apparatus, there is an increased recent demand for the development of a compact apparatus structure recently. There is thus an increasing demand for a heating unit having a simple structure and good heat uniformity.

The above-described trend has promoted the adoption of heating units which are each of the cylindrical and self-standing type having no porcelain insulators and individually have a simple structure making use of a single-stage heater. At the same time, it has become the primary concern to improve the uniformity in temperature in such a heating unit.

DETAILED DESCRIPTION OF THE PREFERRED EMBODIMENT

A heating unit alone, which is formed of a heater and a cylinder disposed inside the heater, has been disclosed in Japanese Patent Publication No. 50,276/1980. On the other hand, a cylindrical, self-standing and single-stage heater has also been disclosed in Japanese Patent Laid-open No. 97,907/1979, etc.

In the above heating unit, the lower extremity of a cylinder 7 is, as apparent from FIG. 1 of the accompanying drawings, hermetically connected to a lower lid 3 which forms a pressure vessel together with a pressure cylinder 1 and an upper lid 2. Two gas flow passages 4*a*,4*b* are formed respectively in the lower lid 3 and table 4 and the upper lid 2. A gas is thus caused to travel in the directions as indicated by the arrows in FIG. 1, namely, through the lower gas flow passage 4*a*, the interior of the cylinder 7, an intercylinderical spacing established between the cylinder 7 and heater 6, a clearance formed underneath a heat-insulating layer 5, an inter-cylindrical spacing established between the heat-insulating layer 5 and the pressure cylinder 1, and the upper gas flow passage 4*b*, and then recirculated to the lower gas flow passage 4*a*. The principal objective of the gas is to accelerate the cooling velocity of material M placed on the table 4 and under treatment.

SUMMARY OF THE INVENTION

With the foregoing in mind, an object of this invention is to solve the aforementioned problems, make a heating unit compact and enlarge the constant temperature zone so as to use the interior spacing of a pressure vessel more effectively by providing, in an HIP apparatus equipped with such a simple heating unit as mentioned above, a convection-promoting cylinder inside the heater with its upper part extending above the heater so that natural convection can be provided around the heater.

In one aspect of this invention, there is thus provided a hot isostatic pressing apparatus equipped with a pressure vessel, a heat-insulating layer provided within the pressure vessel and a heating unit disposed inside the heat-insulating layer, wherein the heating unit is formed of a cylindrical, self-standing and single-stage heater mounted on an electrical insulator, which is in turn provided in a low-temperature zone of the pressure vessel, and a convection-promoting cylinder provided inside the heater with its lower part supported on the electrical insulator, the upper extremity of the convection-promoting cylinder being located above the upper extremity of the heater and the convection-promoting cylinder defining a gas flow passage in the lower part thereof.

In the hot isostatic apparatus according to the present invention, the natural convection of the gas is promoted in the vicinity of the heater owing to the provision of the convection-promoting cylinder inside the heater. This has improved the temperature uniformity in the treatment spacing formed in the pressure vessel. According to experimental results, it has been proven that the provision of the convection-promoting cylinder enables enlargement of the constant temperature zone by 1.5–3 times as compared with a heating unit having no convection-promoting cylinder where the heights of their heaters are identical. Therefore, the hot isostatic pressing apparatus is believed to bring about a significantly-remarkable effect.

The above-mentioned improved temperature uniformity has in turn made it possible to use a single-stage heater instead of a conventional multistage heater, thereby bringing about another advantage in that the size reduction of the hot isostatic pressing apparatus, which meets today's demands, can be promoted.

Furthermore, the heater is cylindrical, self-standing, is mounted on the electrical insulator and is not provided with any porcelain insulators. This structural feature has made the heater extremely compact in the radial direction, thereby allowing for effective utilization of the interior spacing of the pressure vessel and to the maximum extent. Besides, exclusion of porcelain insulators has solved the danger that the insulation of the heater may be lowered due to contamination of the porcelain insulators. Moreover, the above heating unit has resulted in a simplification of the overall structure of a hot isostatic pressing apparatus and is thus very useful for long-term steady operations.

The above and other objects, features and advantages of the present invention will become apparent from the following description and the appended claims, taken in conjunction with the accompanying drawings.

Figure 1:
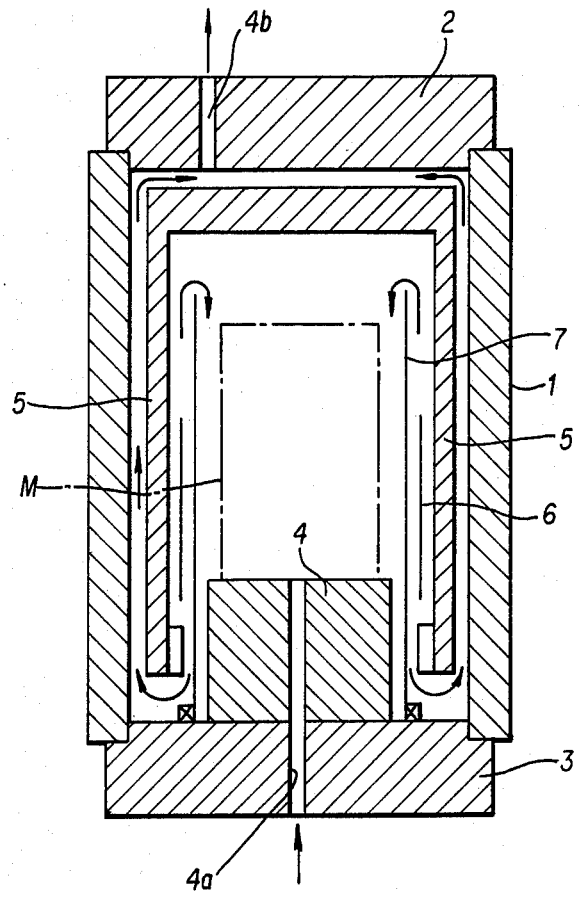
FIG. 1 PRIOR ART
FIG. 1 is a simplified schematic cross-sectional view of one example of a conventional hot isostatic pressing apparatus.

The prior art structure of the heating unit in FIG. 1 is distinguished from that of the invention heating unit making use of the convection-promoting cylinder which defines a convection-promoting gas flow passages in a lower part thereof so that the convection of a high-temperature and high-pressure gas between the inside and outside of the cylinder is promoted and the uniformity in temperature of the treatment chamber is thus improved.

It is particularly noteworthy that the enlarged uniform temperature zone owing to the above-mentioned promotion of convection in accordance with this invention has attained, in combination with the simplified structure of the heating unit owing to the adoption of a single-stage heater, both of the above-mentioned objects, namely, size reduction of the apparatus and improvement in temperature uniformity.

A specific embodiment of the present invention will hereinafter be described with reference to FIGS. 2–4 of the accompanying drawings.

Figure 2:
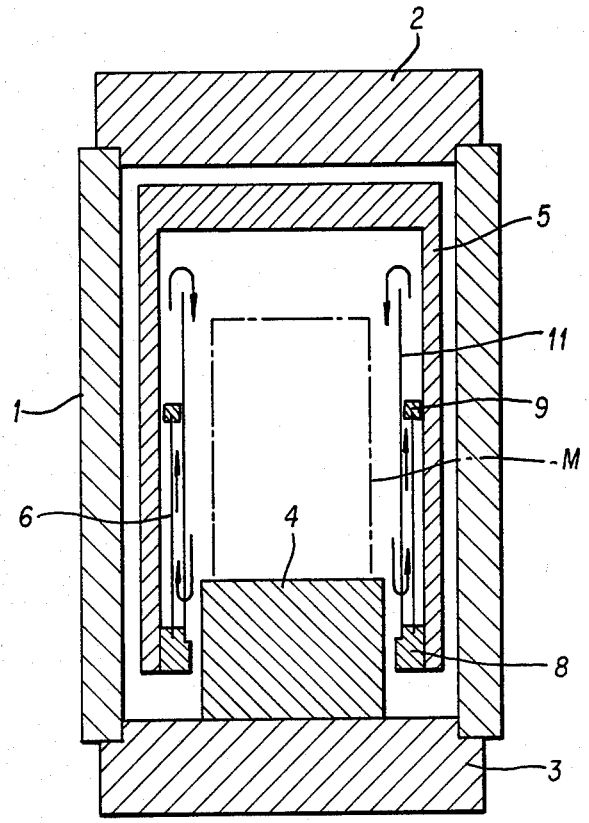
FIG. 2 is a simplified schematic cross-sectional view of a hot isostatic pressing apparatus according to one embodiment of the present invention.
Figure 3:
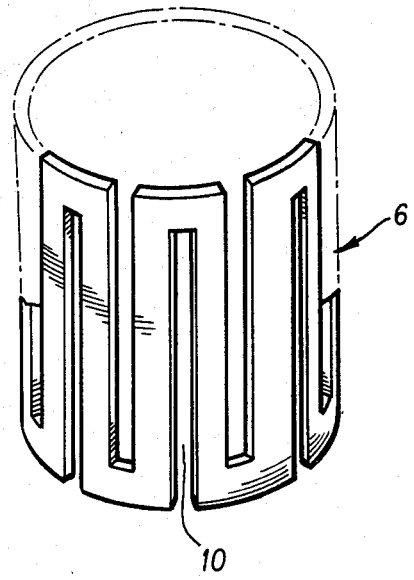
FIG. 3 is a partially cut-away, perspective view of one example of a heater.

In FIG. 2, the pressure vessel is the same as that illustrated in FIG. 1 in that it is constructed of a pressure cylinder 1 and upper and lower lids 2,3 a heat-insulating layer 5 disposed within the pressure vessel and a heater 6 disposed inside the heat-insulating layer 5.

In FIG. 2, the heater 6 is, however mounted on an electrical insulator 8 of a ceramic material or the like, which insulator is provided in a low temperature zone above the lower lid 3. The heater 6 is fixed by suitable means which per se are known in the art. The heater 6 is also provided at its upper part with a guide ring 9 which is also made of an electrically-insulating material such as a ceramic material.

It is important from the viewpoint of achieving size reduction of the apparatus that the heater 6 is, as described above, of the cylindrical, self-standing and single-stage type. The heater 6 is generally a cylindrical heating member made of a high fusing point metal such as Mo, Ta, W, or the like and, as illustrated in FIG. 3, is provided with longitudinally-extending slits 10 or transverse through-holes as needed to adjust its resistance to a desired level.

It should, however, be borne in mind that the material making up the heater 6 is not necessarily limited to a metal but instead may be formed of a non-metallic material, for example, graphite.

A convection-promoting cylinder 11 is further provided upright inside the heater 6 with its lower extremity supported by the electrical insulator 8 and its upper extremity extending beyond the guide ring 9, thereby forming flow spacing for the gaseous pressure medium of the high temperature and pressure between the cylinder 11 and the heater 6.

The convection-promoting cylinder 11 constitutes an important feature in the hot isostatic pressing apparatus of this invention. The cylinder 11 may be made of a metallic material similar to the heater 6 but a gas-tight ceramic member made of a material such as alumina, boron nitride or the like may also be used depending on the temperatures to be reached during its operation. However, the cylinder 11 is generally made of a heat-resistant metal such as Mo or its alloy, stainless steel or an Ni-base alloy.

It is indispensable that the upper extremity of the convection-promoting cylinder 11 extends beyond the upper extremity of the heater 6 and is located above the upper extremity of the heater 6, in view of its role. The height of the convection-promoting cylinder 11 is suitably determined in accordance with the height of the heater 6. However, the positional difference between the upper extremity of the heater 6 and that of the convection-promoting cylinder 11 is correlated to the treatment temperature and pressure in the pressure vessel and must be determined in accordance with the temperature and pressure in each treatment operation. Generally speaking, it is, however, preferred to make the height of the convection-promoting cylinder 11 be 1.3–2.0 times that of the heater 6.

Figure 4:
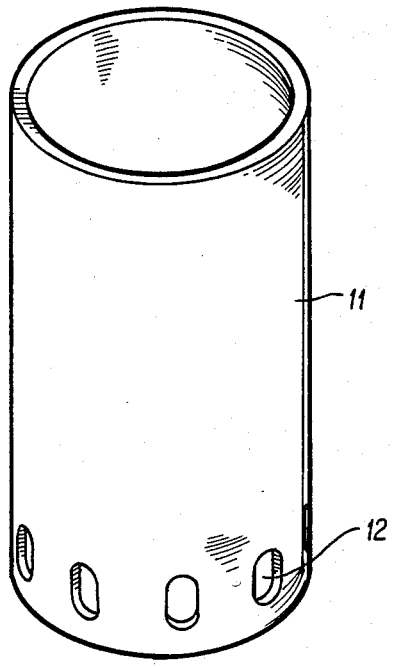
FIG. 4 is a perspective view of one example of a convection-promoting cylinder.

The convection-promoting cylinder 11 defines gas flow passages, for example, gas flow holes 12 in a lower part of the cylinder as illustrated in FIG. 4 so that convection of the gas is promoted further. The extent of convection may be controlled by varying the number and size of the gas flow holes 12.

In the above-described hot isostatic pressing apparatus of the present invention, the gaseous pressure medium of high temperature and pressure is caused to convect along the circumference of the material which is placed on the table 4 of the pressure vessel and under treatment. As illustrated by the arrows in FIG. 2, the gaseous pressure medium transfer a heat and pressure to the material while it travels downward along the material. The descending gas is then allowed to pass through the gas flow holes 12 formed through the lower part of the convection-promoting cylinder 11, is heated by the heater 6, and travels upward through the intercylindrical spacing between the heater 6 and the cylinder 11. After contributing to the heating and pressing of the material M under treatment in the pressure vessel, the gaseous pressure medium is recirculated to the gas flow holes 12 through the spacing between the material M and the cylinder 11 in the same manner as described above. This convection step is then repeated. In the course of the convection of the gaseous pressure medium, the HIP treatment is carried out by the gaseous pressure medium in the high-temperature and high-pressure atmosphere.

Even if the height of the heater 6 is short, the temperature difference in the vertical direction in the treatment spacing is substantially eliminated owing to the promoted convection due to the convection-promoting cylinder 11 and the uniform temperature zone in the treatment chamber is thus expanded substantially to the spacing surrounded by the cylinder 11, thereby significantly expanding the treatment spacing of the same temperature.

Having now fully described the invention, it will be apparent to one of ordinary skill in the art that many changes and modifications can be made thereto without departing from the spirit or scope of the invention as set forth herein.

What is claimed is:

1. A hot isostatic pressing apparatus comprising:

(a) a cylindrical pressure vessel comprising a pressure cylinder and a lower lid;

(b) a cup-shaped, downwardly open heat-insulating layer disposed within said pressure cylinder so as to define a first intercylindrical flow passage between the inner surface of said cylindrical pressure cylinder and the outer surface of said cup-shaped heat-insulating layer, the bottom edge of said cup-shaped, downwardly open heat-insulating layer being spaced above said lower lid;

(c) a ring-shaped electrical insulator projecting inwardly from the inner surface of said cup-shaped heat-insulating layer in a low temperature zone near the bottom of said pressure vessel;

(d) a heating unit of the cylindrical, self-standing, single-stage type mounted on said electrical insulator and extending upwardly therefrom, said cylindrical heating unit being disposed within said cup-shaped heat-insulating layer so as to define a second intercylindrical flow passage between the inner surface of said cup-shaped heat-insulating layer and the outer surface of said cylindrical heating unit;

(e) a convection-promoting cylinder mounted on said electrical insulator and extending upwardly therefrom beyond the uppermost portion of said cylindrical heating unit, said convection-promoting cylinder having radial gas flow passages through the lower portion thereof and being disposed within said cylindrical heating unit so as to define a third intercylindrical flow passage between the inner surface of said cylindrical heating unit and the outer surface of said convection-promoting cylinder and a fourth intercylindrical flow passage between the inner surface of said cup-shaped heat-insulating layer and the outer surface of said convection-promoting cylinder; and (f) a table upon which the material being pressed is supported during use of the hot isostatic pressing apparatus, said table having an upper material supporting surface which is above the radial gas flow passages in said convection-promoting cylinder, said table being disposed within said convection-promoting cylinder so as to define a fifth intercylindrical flow passage between the inner surface of said convection-promoting cylinder and the outer surface of said table, whereby, when the hot isostatic pressing apparatus is in use, the gaseous pressure medium is caused to convect downwardly along the outer surface of the material being pressed, which material is disposed within said convection-promoting cylinder on top of said table, downwardly in said fifth intercylindrical flow passage, radially outwardly through said radial gas flow passages in said convection-promoting cylinder, upwardly in said second and third intercylindrical flow passages, during which passage it is heated by said cylindrical heating unit, after which it continues upwardly in said fourth intercylindrical flow passage, passes over the top of said convection-promoting cylinder, and once again is caused to convect downwardly along the outer surface of the material being pressed, said convection-promoting cylinder serving to substantially eliminate the temperature difference in the vertical direction in the treatment volume inside said convection-promoting cylinder even though said cylindrical heating unit is short relative to the height of the treatment volume.

2. A hot isostatic pressing apparatus as recited in claim 1 wherein said cylindrical heating unit and said convection-promoting cylinder are formed from a metallic material.

3. A hot isostatic pressing apparatus as recited in claim 1 wherein the height of said convection-promoting cylinder is between 1.3 and 2.0 times the height of said cylindrical heating unit.

4. A hot isostatic pressing apparatus as recited in claim 1 and further comprising a guide ring made of an electrically insulating material, said guide ring being carried by the upper edge of said cylindrical heating unit.

5. A hot isosatic pressing apparatus as recited in claim 4 wherein said cylindrical heating unit and said convection-promoting cylinder are formed from a metallic material and said guide ring is formed from a ceramic material.

* * * * *